US005080016A

United States Patent [19]

Osher

[11] Patent Number: 5,080,016

[45] Date of Patent: Jan. 14, 1992

[54] HYDROGEN LOADED METAL FOR BRIDGE-FOILS FOR ENHANCED ELECTRIC GUN/SLAPPER DETONATOR OPERATION

[75] Inventor: John E. Osher, Alamo, Calif.

[73] Assignee: The United States of America as represented by the Department of Energy, Washington, D.C.

[21] Appl. No.: 672,277

[22] Filed: Mar. 20, 1991

[51] Int. Cl.[5] ..... F42B 3/12; F42C 19/12

[52] U.S. Cl. ..... 102/202.7

[58] Field of Search ..... 102/202.7, 202.5

[56] References Cited

U.S. PATENT DOCUMENTS

| | | | |
|---|---|---|---|
| 3,169,482 | 2/1965 | Noble | 102/202.7 |
| 3,669,022 | 6/1972 | Dahn et al. | 102/202.7 |
| 4,312,271 | 1/1982 | Day et al. | 102/202.7 |
| 4,471,697 | 9/1984 | McCormick et al. | 102/202.5 |
| 4,602,565 | 7/1986 | MacDonald et al. | 102/202.7 |
| 4,762,067 | 8/1988 | Barker et al. | 102/313 |
| 4,831,932 | 5/1989 | Bayerkohler et al. | 102/202.5 |
| 4,928,595 | 5/1990 | Weingart et al. | 102/202.7 |

OTHER PUBLICATIONS

UCRL-77639, "A New Kind of Detonator-The Slapper", dated Feb. 27, 1976.

*Primary Examiner*—Charles T. Jordan

*Attorney, Agent, or Firm*—Henry P. Sartorio; L. E. Carnahan; William R. Moser

[57] ABSTRACT

The invention provides a more efficient electric gun or slapper detonator which provides a higher velocity flyer by using a bridge foil made of a hydrogen loaded metal.

18 Claims, 5 Drawing Sheets

HYDROGEN LOADED METAL FOR BRIDGE-FOILS FOR ENHANCED ELECTRIC GUN/SLAPPER DETONATOR OPERATION

The United States Government has rights in this invention pursuant to Contract No. W-7405-ENG-48 between the U.S. Department of Energy and the University of California, for the operation of Lawrence Livermore National Laboratory.

FIELD OF THE INVENTION

The slapper detonator, as described by J. R. Stroud in Lawrence Livermore Laboratory document UCRL-77639, "A New Kind of Detonator—The Slapper", dated Feb. 27, 1976, "operates by exploding a thin metal foil, which accelerates a plastic film across a gap to impact on a high-density secondary explosive".

Traditionally, the thin metal foil, or bridge, is either cut from a thin ribbon of metal or etched from a metal film on a dielectric substrate. The plastic film is comprised of polyester such as mylar, or polyimide such as kapton, and is placed over the bridge to act as the flyer. The gap is provided by a piece of plastic shim stock with a punched hole, called a barrel, that is bonded to the flyer film. Finally, an explosive pellet is placed over the hole in the barrel. In operation the explosion of the thin metal "bridge-foil" punches out a gun-bore-sized section of the flyer film. The hot expanding plasma resulting from the foil explosion and the accompanying magnetic forces on the plasma can accelerate this section of film to very high velocities. For slapper detonators a normal velocity is up to 5 km/s, while for large electric guns films can be accelerated up to about 18 km/s. Slapper detonators may be used to impact the flyer on to a secondary explosive to create a shock wave which detonates the insensitive secondary explosive.

Even though the slapper detonator, since its inception, has become a staple component of the art of detonator science, there remains a continuing need for improved slapper detonators of higher efficiency and which provide higher velocity flyers.

The term electric gun here is applied to designate larger-area and higher-energy versions of the same ohmically heated exploding bridge-foil configuration used in the slapper detonator. Electric guns are used to drive large area flyer plates for hypervelocity applications. Electric guns have bridge foil and gun bore dimensions which range from 1 cm to over 10 cm in width or diameter, while slapper detonators have bridge foils and gun bores that are generally less than 1 mm in width or diameter.

SUMMARY OF THE INVENTION

It is an object of the invention to provide a more efficient electric gun or slapper.

It is another object of the invention to provide an electric gun or slapper which provides a higher velocity flyer.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

The invention comprises an electric gun or slapper detonator with a bridge foil made of a hydrogen loaded metal.

BRIEF DESCRIPTION OF THE DRAWINGS

The accompanying drawings, which are incorporated and form a part of the specification, illustrate embodiments of the invention and, together with the description, serve to explain the principles of the invention.

DETAILED DESCRIPTION OF THE EMBODIMENTS

Figure 1:
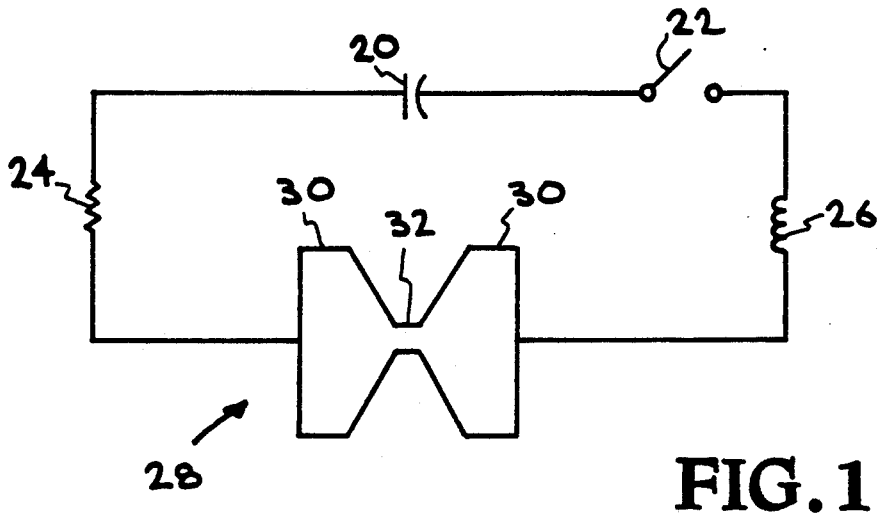
FIG. 1 is a schematic illustration of the electrical circuit used in an electric gun.

FIG. 1 is a schematic illustration of the electrical circuit used in a preferred embodiment of the invention. The circuit has a capacitor 20 with a first end, which is electrically connected to a first end of an open switch 22. Electrically connected between a second end of the open switch 22 and the second end of the capacitor 20 is a butterfly shaped section 28. The butterfly shaped section 28 comprises two wing shaped copper sheet electrodes 30 and a thinner and narrower bridge foil 32. The wing shaped electrodes 30 are made of a low resistance material such as copper. The thin bridge foil 32 is made of a hydrogen loaded metal which in this embodiment is titanium hydride. The circuit has an effective circuit resistance 24 and an effective circuit inductance 26.

Figure 2:
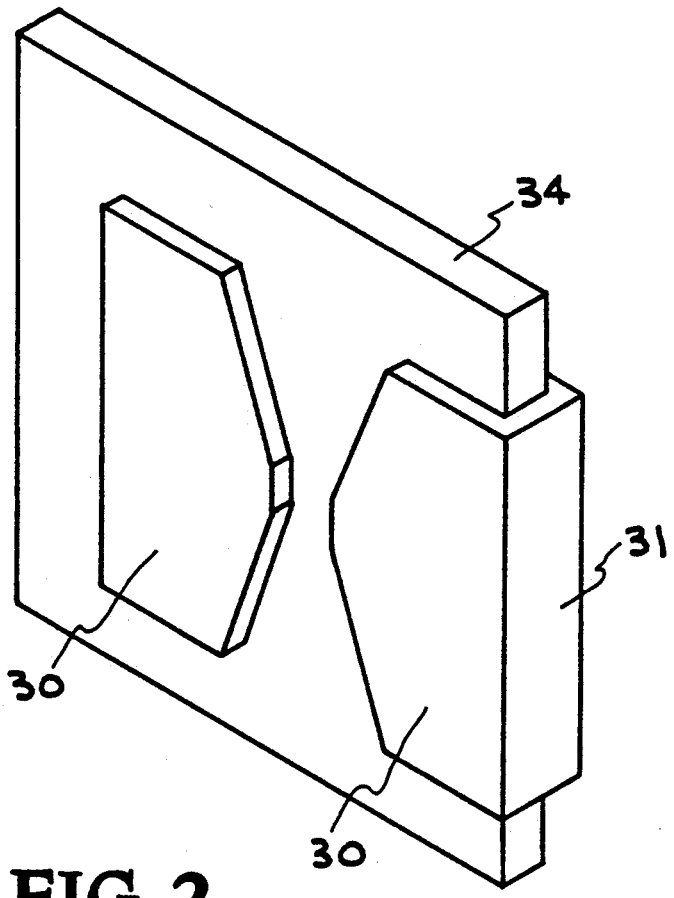
FIG. 2 is an illustration of electrodes on a laminate surface used in an electric gun.
Figure 3:
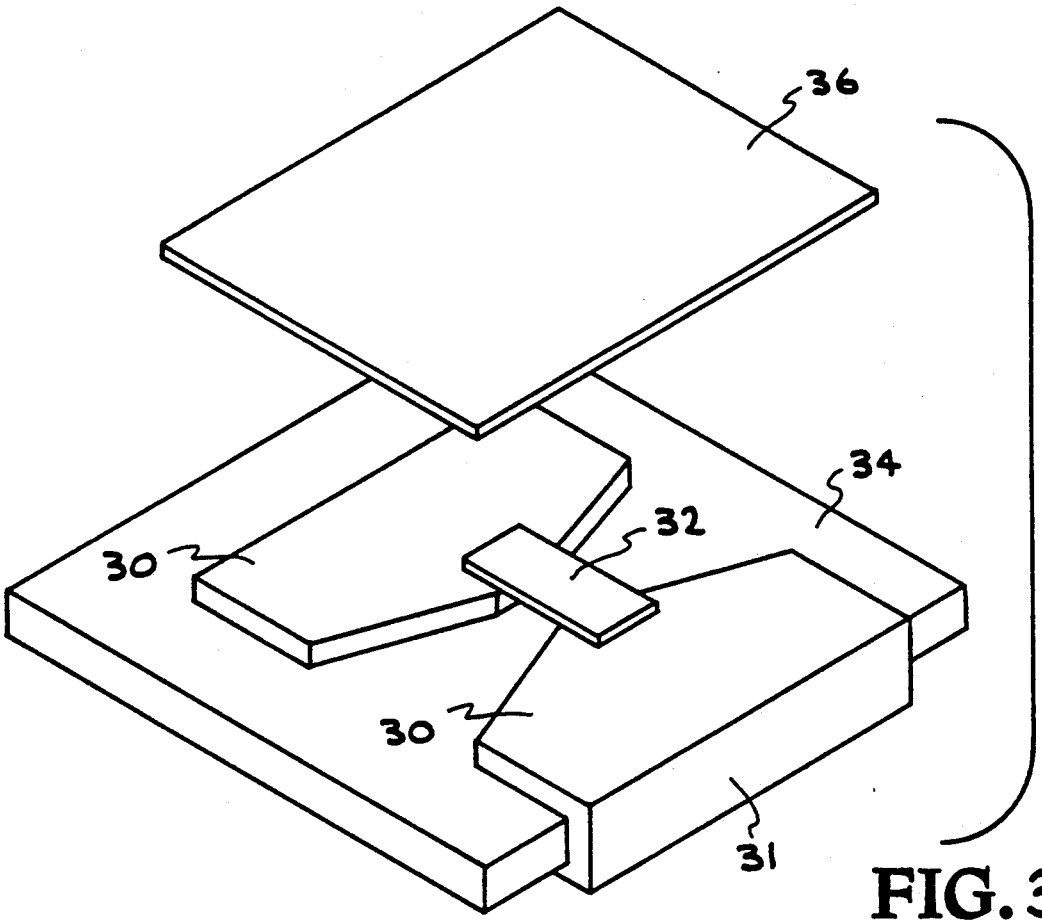
FIG. 3 is an illustration of the electrodes in FIG. 2, with a bridge foil placed across the electrodes and with a mylar film.
Figure 4:
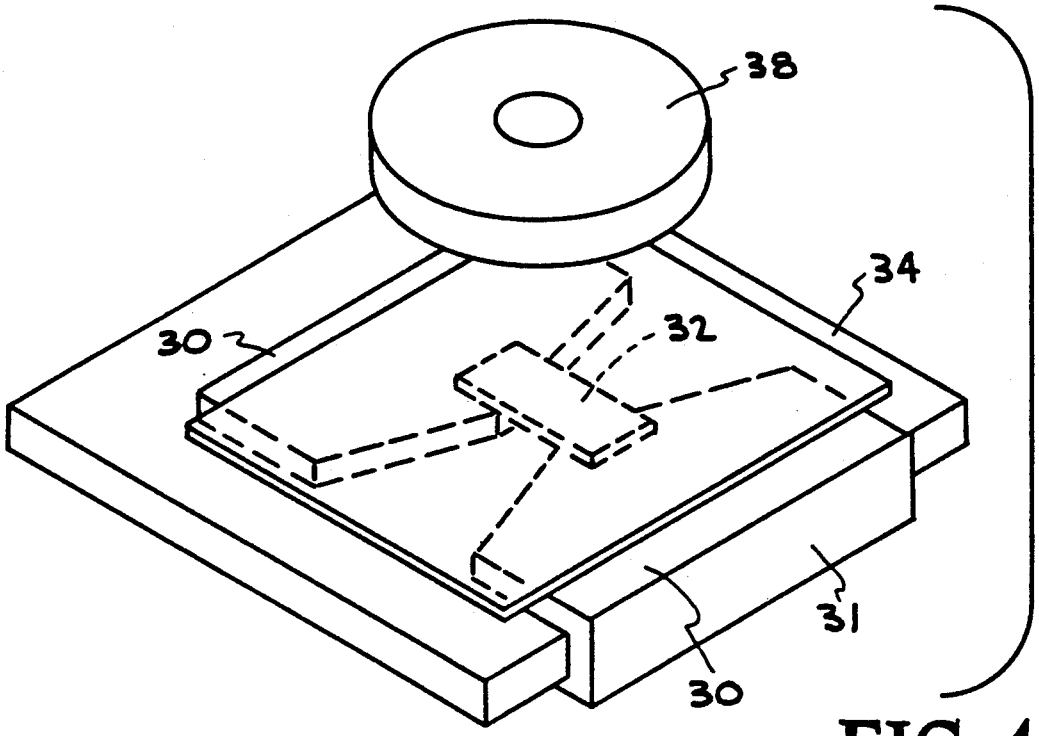
FIG. 4 is an illustration of the apparatus in FIG. 3, with the mylar film placed over the electrodes.
Figure 5:
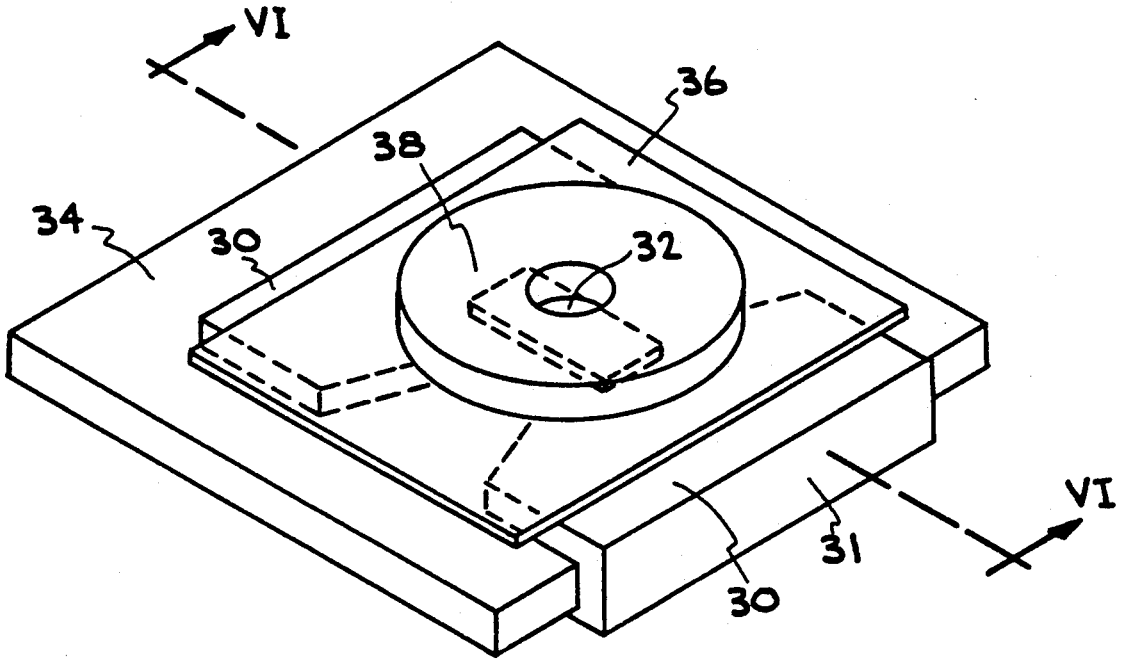
FIG. 5 is an illustration of the assembled electric gun of FIG. 4.
Figure 6:
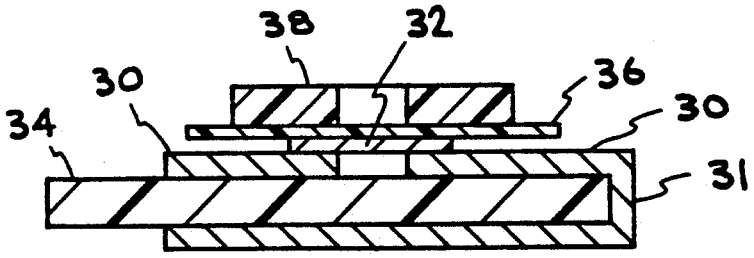
FIG. 6 is an illustration of a cross-section of the electric gun illustrated in FIG. 5 along cut lines VI—VI.

FIG. 2 illustrates the wing shaped copper sheet electrodes 30 of the embodiment illustrated in FIG. 1 on a laminate surface 34 which provides support for the electrodes and insulation between the upper wing shaped electrodes 30 and the return current lead electrode 31 which continues under the laminate 34. FIG. 3 illustrates the wing shaped electrodes 30 with the thin bridge foil 32 made of titanium hydride bridging across the electrodes 30. A mylar sheet 36 is placed over the bridge foil 32 as illustrated in FIG. 4. A barrel 38 formed by a plastic ring with a hole is placed over the mylar sheet 36 so that the hole in the barrel 38 is above the bridge foil 32 as illustrated in FIG. 5. FIG. 6 is a cross-section of the apparatus in FIG. 5 along cut lines VI-VI. The return lead 31 is typically folded to form a low inductance parallel plate set of leads to the bridge foil 32.

In operation, the capacitor 20, in FIG. 1, is charged to a high voltage on the order of 5 kV or more depending on the circuit parameters, while the switch 22 is open. The switch 22 is closed placing a high voltage across the wing shaped electrodes 30. This places a high voltage across the titanium hydride bridge foil 32, causing a very high current to flow in the thin and narrow bridge foil 32 and ohmically heating the bridge foil 32 until the bridge foil 32 explodes. The exploding bridge foil 32 pushes against the part of the mylar sheet 36 above the bridge foil 32 and under the hole in the barrel 38, so that a gun bore size part of the mylar sheet 36 above the bridge foil 32 and under the hole in the barrel tears away and becomes a flyer.

Using a bridge foil 32 of titanium with a hydrogen loading of approximately 0.385 hydrogen/titanium, showed an approximately 20% increase in the final attained velocity over an identical electric gun using a pure titanium bridge foil of the same thickness, which is about the same velocity as a flyer from an identical electric gun using an aluminum bridge foil of the same thickness as used in the prior art. The 0.385 hydrogen/titanium is the ratio of the number of hydrogen atoms divided by the number of titanium atoms in the foil.

A higher ratio of hydrogen to titanium is desirable. Predictions based on kinetic theory and Gurney theory for the equipartition of the impulse between the driving gas and flyer indicate that using a bridge foil of approximately 0.67 or higher ratio of hydrogen to titanium will produce a flyer with a final attained velocity greater than 10% over an identical electric gun using an aluminum bridge foil. This increase in velocity also represents a gain of 20% or more in the efficiency (conversion from stored electrical energy to kinetic energy of the flyer).

Figure 7:
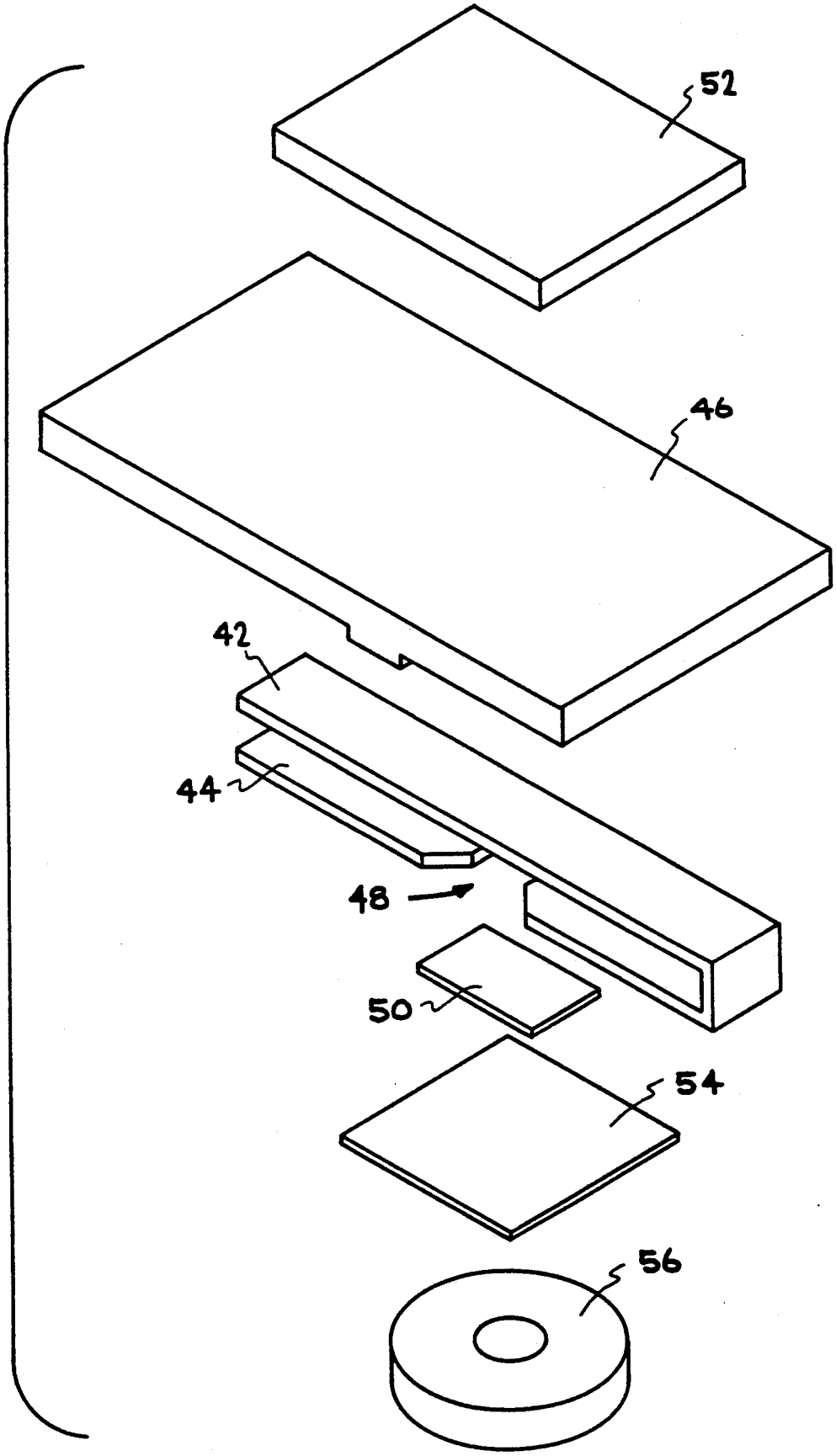
FIG. 7 is an illustration of the parts of another preferred embodiment of the invention used in a slapper detonator.
Figure 8:
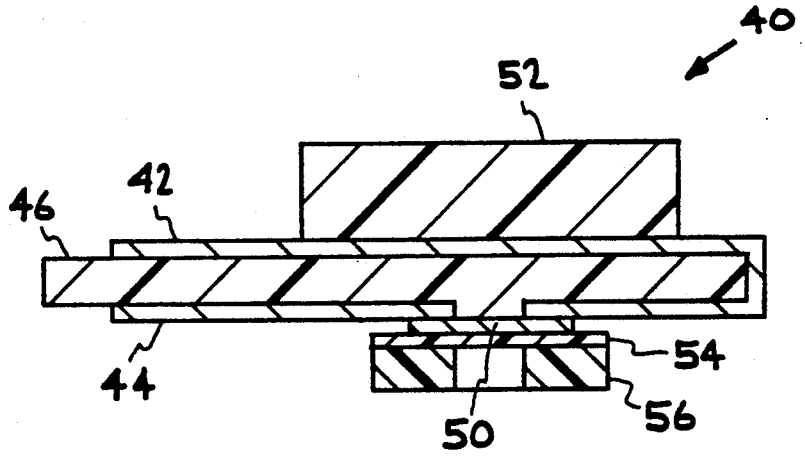
FIG. 8 is a cross-sectional view of the assembled slapper detonator illustrated in FIG. 7.

FIG. 7 illustrates the parts of a slapper detonator forming another preferred embodiment of the invention. FIG. 8 is a cross-sectional view of the assembled slapper detonator 40. The slapper detonator has a pair of electrodes 42 and 44 which are made of an electrical conducting material, which in this embodiment is copper. The pair of electrodes are placed around a block 46 of insulative material such as a dielectric material, so that the electrodes are separated by a gap 48. A bridge foil 50 of a hydrogen loaded metal which in this embodiment is titanium hydride is placed across the gap 48. An inertial backing 52 is placed on a side of the dielectric block 46 opposite from the gap 48. A sheet of mylar 54 is placed over the bridge foil 50 and the gap 48. A barrel 56 formed by a plastic ring with a hole is placed over the mylar sheet 54 so that the hole of the barrel 56 is over the bridge foil 50.

In operation a high voltage is placed across the ends of the pair of electrodes 42 and 44. As a result a high voltage is placed across the titanium hydride bridge foil 50. The high voltage causes the bridge foil 50 to explode. The exploding bridge foil 50 pushes against the part of the mylar sheet 54 above the bridge foil 50 and under the hole in the barrel 56, so that the part of the mylar sheet 54 above the bridge foil 50 and under the hole in the barrel 56 tears away and becomes a flyer. When the slapper is used as a detonator, a high explosive is placed above the hole in the barrel 56, so that when the flyer passes through the hole in the barrel 56 it collides with the high explosive creating a high pressure shock wave causing the high explosive to explode.

As with the electric gun, the titanium hydride bridge foil will provide a flyer with a higher velocity than an identical slapper with a titanium flyer and with a corresponding increase in efficiency.

Using a hydrogen loaded metal, which includes hydride metals, provides two advantages. First, the early release of the hydrogen content of the bridge foil is expected to produce a higher flyer velocity for a given stored energy and also extend the maximum attainable single stage gas velocity available for accelerating the flyer, since the gas/plasma thermal velocity scales as the inverse square root of the atomic or molecular mass involved. The increase in velocity from a given stored energy represents an increase in efficiency. The extension of the maximum velocity for hydrogen as compared to aluminum extends the more efficient thermal acceleration phase from about 6 to 8 km/s for aluminum to 20–30 km/s for hydrogen. Acceleration above this velocity is from magnetic forces at a reduced efficiency. Second, the hydrogen loading of a metal lowers the density of the metal which tends to reduce the energy needed to evaporate the loosely bound hydrogen and explode the bridge foil. This also allows the use of relatively high density metals which are loaded with hydrogen.

In the preferred embodiments described above hydrogen loaded titanium was used. Other hydrogen loaded metals such as zirconium, nickel or palladium can also be used. In one preferred embodiment, the hydrogen loading was approximately 0.385 hydrogen/titanium. In the preferred embodiment a hydrogen loading will range from 0.385 to 2.0 hydrogen/titanium.

In preferred embodiments of the slapper detonators or electric guns a voltage between 3 kv and 120 kV is desirable.

In the preferred embodiments the mylar film used to produce the flyer can be replaced with other dielectric films such as sapphire, teflon, or kapton.

The foregoing description of preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. An apparatus for accelerating a flyer, comprising:

a bridge foil of a hydrogen loaded metal adjacent to the flyer; and means for placing a sufficiently high voltage across the bridge foil to cause the bridge foil to explode thus accelerating the flyer.

2. An apparatus as claimed in claim 1, further comprising a barrel with a hole, where in the barrel is adjacent to the flyer.

3. An apparatus as claimed in claim 2, wherein the metal is titanium, zirconium, nickel, or palladium.

4. An apparatus as claimed in claim 3, wherein the hydrogen loading is in the range of 0.3 to 2.0 hydrogen/metal.

5. An apparatus as claimed in claim 1, wherein the hydrogen loaded metal has a ratio of the number of hydrogen atoms divided by the number of metal atoms in the range between 0.3 and 2.0.

6. An apparatus as claimed in claim 5, wherein the means for placing a voltage comprises a first electrode and a second electrode made of a highly conducting material and spaced apart, wherein the bridge foil is electrically connected between the first electrode and the second electrode.

7. An apparatus as claimed in claim 1, wherein the metal is titanium, zirconium, nickel, or palladium.

8. An apparatus as claimed in claim 7, wherein the hydrogen loading is in the range of 0.3 to 2.0 hydrogen/metal.

9. An apparatus as claimed in claim 7, wherein the hydrogen loading is in the range of 0.6 to 2.0 hydrogen/metal.

10. A method for producing a high velocity flyer, comprising the steps of:

placing the flyer adjacent to a bridge foil of a hydrogen loaded metal; and placing a high voltage across the bridge foil.

11. A method as claimed in claim 10, wherein the bridge foil metal is titanium, zirconium, nickel, or palladium.

12. A method as claimed in claim 11, wherein the hydrogen loading is in the range of 0.3 to 2.0 hydrogen/metal.

13. A method as claimed in claim 12, wherein the hydrogen loading is in the range of 0.6 to 2.0 hydrogen/metal.

14. A method as claimed in claim 10, wherein the hydrogen loaded metal has a ratio between the number of hydrogen atoms divided by the number of metal atoms in the range between 0.3 and 2.0.

15. A method as claimed in claim 14, wherein the hydrogen loaded metal has a ratio between the number of hydrogen atoms divided by the number of metal atoms in the range between 0.6 and 2.0.

16. An apparatus, comprising:

a barrel with a hole through the barrel;

a thin dielectric film with a first side and a second side, wherein the first side of the thin dielectric film is adjacent to the hole of the barrel;

a bridge foil of a hydrogen loaded metal adjacent to the second side of the thin dielectric film; and means to place a high voltage across the bridge foil, wherein the high voltage is sufficient to cause the bridge foil to explode.

17. An apparatus as claimed in claim 16, wherein the hydrogen loading is in the range of 0.3 to 2.0 hydrogen/metal.

18. An apparatus as claimed in claim 17, wherein the metal is titanium, zirconium, nickel, or palladium.

* * * * *